United States Patent [19]

Seiler

[11] 3,967,652

[45] July 6, 1976

[54] SPRING HOOK FOR THE HARNESS PULL OF A DOUBLE-LIFT OPEN-SHED JACQUARD MACHINE

[75] Inventor: Wolfgang Seiler, Rheydt, Germany

[73] Assignee: Staubli Ltd., Horgen-Zurich, Switzerland

[22] Filed: July 3, 1974

[21] Appl. No.: 485,601

[30] Foreign Application Priority Data

July 6, 1973 Switzerland ..... 9917/73

[52] U.S. Cl. ..... 139/59; 139/65

[51] Int. Cl.[2] ..... D03C 3/00; D03C 3/08

[58] Field of Search ..... 139/59–65

[56] References Cited

UNITED STATES PATENTS

| | | | |
|---|---|---|---|
| 500,852 | 7/1893 | Charcot | 139/63 |
| 838,279 | 12/1906 | Senn | 139/63 |
| 3,455,339 | 7/1969 | Seiler | 139/59 |
| 3,835,895 | 9/1974 | Bassi | 139/65 |

OTHER PUBLICATIONS 1,137,695, 10–4–1962 German Application (Kenk).

*Primary Examiner*—James Kee Chi

*Attorney, Agent, or Firm*—Woodhams, Blanchard and Flynn

[57] ABSTRACT

Hook construction for the harness pull of a double-lift open-shed Jacquard machine. For use in a Jacquard machine, as aforesaid, there is provided a construction for a resilient harness pull hook, same having relatively resilient characteristics in the upper portion thereof and relatively rigid characteristics in the lower portion thereof. Said construction may be obtained by appropriate treatment of the hooks during the process of manufacture of same or said characteristics may be obtained by fastening, as by welding, two separate components, one thereof being relatively resilient and the other thereof being relatively rigid. An offset may be advantageously provided in the resilient portion of such hooks for improving the guidance thereof.

9 Claims, 7 Drawing Figures

SPRING HOOK FOR THE HARNESS PULL OF A DOUBLE-LIFT OPEN-SHED JACQUARD MACHINE

FIELD OF THE INVENTION

The invention relates to a single shank, resiliently flexible, hook for the harness pull of a double-lift open-shed Jacquard machine, which hook has two connecting noses and a support nose arranged on the hook below the connecting noses and a spring which engages near the support nose, preferably in the form of a resilient extension which is return bent through 180°, and which is supported on the bars of a stationary grate, wherein for each machine two noncrossing lifting knife boxes with lifting knives, such boxes operating in opposite directions, are arranged for cooperation with the upper connecting noses and the lower connecting noses of the hooks and a stationary upper-shed knife grate for cooperation with the support noses and further wherein the machine has a needle mechanism which controls the connecting noses to engage and disengage the movable lifting knives and the support noses to engage and disengage the fixed upper-shed knives.

BACKGROUND OF THE INVENTION

Such machines have the disadvantage that the unconnected connecting noses of the descending hooks often unintentionally engage the draw knife of the rising knife box, which creates operating errors.

In recognition of this situation, German Pat. No. 1,299,258 among others, developed a single-shank hook which is characterized in that two superposed connecting noses for the lifting knives are provided at both ends of a two-arm lever which is secured rotatably on the one of the hook legs and which must be swung against the action of a restoring force from its central position, in which both noses can reach engagement with their ends and the associated knives, through the knife engagement in one nose so that the other nose lies outside of the affected zone of the other knife. With this design, an unintentional suspension of the noses on the knives has been avoided. However, this hook is composed of several components and forms a high-mass part which because of its inertia does not permit speed increase.

German Pat. No. 75,878 discloses a three-nose, single-shank hook for a double-lift open-shed Jacquard machine. This machine has lifting knives to which the hooks with their noses controlled are joined. The hooks are moved laterally by means of guide grates so that they are not carried along by the second lifting knife during their axial operating movement. For this purpose the entire hook shank consists of the same resiliently flexible material.

SUMMARY OF THE INVENTION

The purpose of the invention is to provide a hook which is of light construction, through which a high operating speed can be achieved, and which follows the controlled movements, in particular the retracting movements, of the unengaged lifting knives during also a high-speed operation.

This is achieved with a hook of the above-mentioned type, which is characterized according to the invention in that the hook shank has in the zone between the two connecting noses and in the zone immediately below the lower connecting nose a softer spring characteristic than is provided in the zone between the lower connecting nose and the support nose.

BRIEF DESCRIPTION OF THE DRAWING

Exemplary embodiments of hooks are illustrated in the drawing, in which.

DETAILED DESCRIPTION

Figure 1:
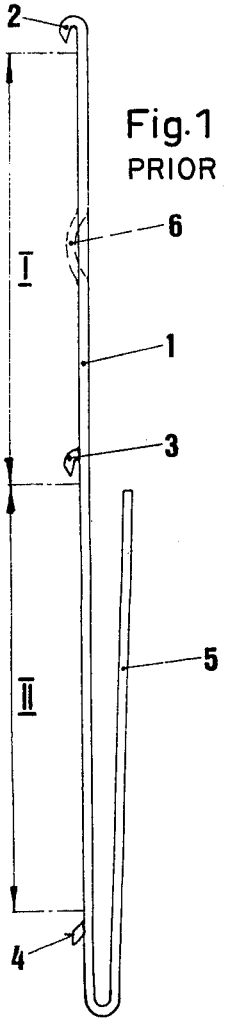
Fig.1 PRIOR ART
FIG. 1 is a known hook.

The hook according to FIG. 1 consists of the shank 1, the upper end of which is bent to form the upper connecting nose 2, while the lower end after being bent through approximately 180° passes into the resilient extension 5. The lower connecting nose 3 and the support nose 4 are also provided on the shank. This known hook is made from a single steel wire or steel rod and has the same spring characteristics over its entire shank length.

During the manufacture of the hook of the invention, the steel rod is treated, for example by providing a cross-sectional change or a slot or a combining of several rods, so that the hook shank 1 has in the zone I (between the two connecting noses 2 and 3 and in the zone directly below the lower connecting nose 3) a softer spring characteristic than is the case in the zone II (following the zone I to the support nose 4) where the shank 1 is almost rigid. With this hook a much greater work output can be achieved. The shank 1 is provided with an offset 6 between the connecting noses 2 and 3.

Figure 2:
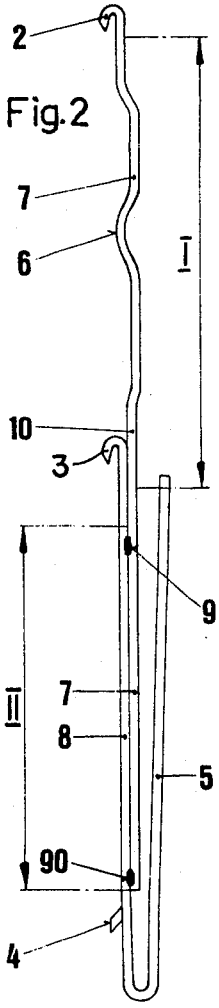
FIG. 2 is a hook embodying the invention.

With respect to manufacture, the hook 10 according to FIG. 2 is much less expensive and simpler. A steel rod with a constant spring characteristic is used throughout. The upper end of the first part 7 of the steel rod is bent to form the upper connecting nose 2, while the lower section of this part 7 extends parallel to the upper section of the second rod part 8 and is welded or soldered to same at two points 9 and 90. The upper end of this second part 8 is also bent and forms the lower connecting nose 3, while the lower part of this rod part 8 is bent to form the resilient extension 5. The support nose 4 is arranged on the part 8 which lies parallel to the first part 7, but slightly below the lower end of the part 7. Also even when the spring characteristics of the two rod parts 7 and 8 are the same, the zone II is more rigid than the remaining zones. By choosing the arrangement to place the first part 7 on the side of the part 8 which is opposite the noses 2, 3, 4, the upper section of the part 7 can be curved rightwardly without much effort, which, as will be discussed below, is of a great advantage for the operation of the machine.

In the embodiment shown the distance between the lower connecting point 90 of the two wires 7 and 8 and the support nose 4 is less than the distance between the upper connecting point 9 and the lower support nose 3. This latter distance is in turn less than the distance between the two connecting points 9 and 90. Further, in one preferred embodiment the zone I and the portion directly therebelow consists of a resilient steel rod having a circular cross section and the zone II, particularly near the support nose 4, comprises a steel member of rectangular cross section.

The distance between the two connecting points 9 and 90 can be varied according to the machine. This will be necessary because the relationship between the rigid and the resilient part is important and differs for each type of machine.

This operation will now be discussed in connection with FIGS. 3 to 7, wherein the hooks are schematically illustrated but the zones with the differing spring characteristic lines are not identified.

The illustrated sections of the double-lift open-shed Jacquard machine consist of the upper lifting knife box 11 with lifting knives and the lower lifting knife box 12 with lifting knives. Between the two lifting knife boxes 11, 12 there is provided the control grate 13 and below the lower lifting knife box 12 the guide grate 14, on which the upwardly bent extensions 5 of the hooks 1 are supported, which causes the noses 2, 3, 4 of the hooks to be urged against the knives 11, 12 and the upper-shed knife grate 20. Below the guide grate 14 are provided the moving needles 15 of the controlling reading-in mechanism 16. The hooks are controlled directly, namely the cylinder 16 which carries the pattern card moves horizontally back and forth and presses the not-illustrated card against the horizontal needles 15 in an already known manner. Needles 15 which rest on the card push the connecting noses 2, 3 or 4 away from the knives 11, 12 or 20. The pressure of the pattern card on the horizontal needles takes place only from the center of the shed standstill to shortly after clearance of the engagement play between knife and connecting noses. Reference numeral 17 identifies the hook bottom of the Jacquard machine, which for each harness pull 18 has one hole 19. Above the hook bottom there is provided the upper-shed knife grate 20.

Figure 3:
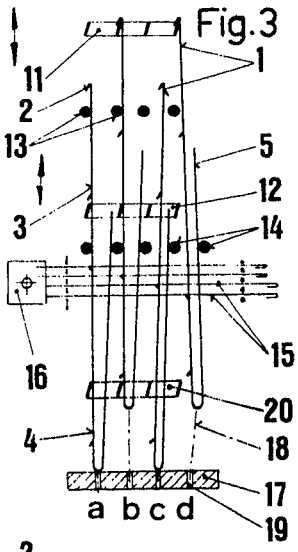
FIGS. 3 and 4 illustrate schematically two operating positions of a group of four needles without an offset between the connecting noses, which can lead to erroneous controls.

In the embodiment according to FIG. 3, it is assumed that the control grate 13, the guide grate 14 and the upper-shed knife grate 20 are stationary. The lifting knife boxes 11 and 12 do not intersect during their lifting movement, see the arrows. The hook *a* is in the lower-shed position. It is supported on the hook bottom and can be carried along by the lower lifting knife through its connecting nose 3. The hook *b* is in the upper-shed position, namely it has been pulled up by the upper lifting knife 11. If now this knife is lowered, then the hook is supported on the upper-shed grate 20 by means of the support nose 4. The hook *c* is — like the hook *a* — in the lower-shed position, however, its upper part according to the pattern has been moved to the right by its control needle. Thus the lower lifting knife will not carry it along during its upward movement. The hook *d* is — like the hook *b* — in the upper-shed position. Since, however, its lower part has now been moved to the right by its control needle, the hook *d* is during the lowering movement of the upper knife 11 also lowered. In this moment, however, the lower knife 12 lifts and the danger exists that the lower knife will take this hook along, thus, that an erroneous control results. To prevent this, the controls which will be discussed hereinafter in connection with FIGS. 4 to 7 are used for which the inventive hook illustrates a great advantage.

Figure 4:
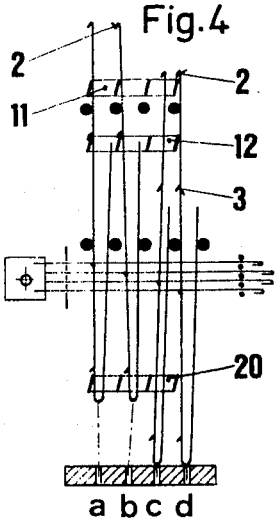

In the modified embodiment according to FIG. 4, the same machine is illustrated as in FIG. 3. However, the upper lifting knife 11 is in the lower-shed position and the lower lifting knife 12 is in the upper-shed position. The hooks of the two harness pulls *b* and *c* are pushed out in pursuance of the pattern by the control needles. If now the lower lifting knife 12 is lowered, then the hook of the pull *b* is not supported on the upper-shed grate 20. However, there exists the danger that the upper lifting knife 11 during its upward movement may take along the upper connecting nose 2 of this hook, which would cause the hook to again reach the upper shed and thereby lead to an incorrect connection. This source of error is also eliminated by the invention. During the movement corresponding to the position illustrated, the hook in the harness pull *a* remains in the upper shed.

The hook in the pull *c* remains in the illustrated position, namely in the lower shed, and the hook in the pull *d* is pulled upwardly, whereby the lower lifting knife 12 during movement past the lower connecting nose presses same away slightly. The hook is slightly curved.

Figure 5:
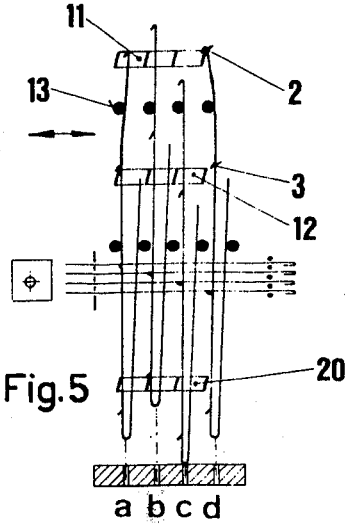
FIGS. 5 and 6 illustrate schematically two further operating positions.

In the modified embodiment according to FIG. 5, the machine is built in the same manner as in the modification according to FIGS. 3 and 4, however, with the difference that the control grate 13 is not stationary, but carries out a horizontal back-and-forth movement as indicated by the arrow. In the zones of the shed intersection, the grate 13 which is provided between the two lifting knife boxes 11, 12 has in this illustration carried out a movement to the right. In so doing, it presses all hooks of the pulls *a, b, c, d* to the right. The hooks *a* (engaging the lower lifting knife 12), *b* (supported in the upper shed on the upper-shed grate 20) and *c* (standing in the lower shed, namely supported in normal position on the hook bottom 17) describe during this sideward movement of the grate 13 a useless lateral shifting which, however, is not damaging for the operation. However, the lateral shifting of the hook in the pull *d* is useful. This hook is deformed because the upper connecting nose 2 is held by the upper lifting knife 11. This curving is further reinforced because the upper part of the hook is more resilient than the lower part. The lower connecting nose 3 goes past the rising lifting knife 12. Thus, an erroneous control cannot occur. When the grate 13 is moved back, the hook follows immediately because here too the rigid part promotes the return into the normal position.

Figure 6:
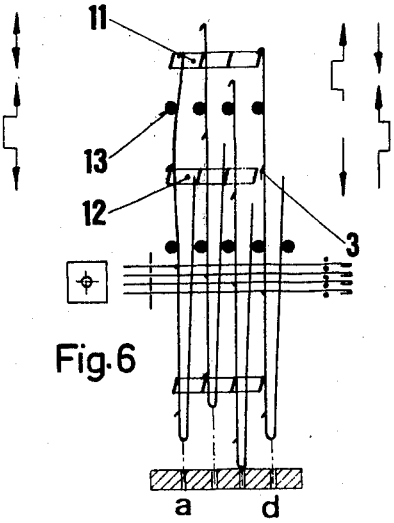

In the modified embodiment according to FIG. 6, the control grate is stationary. However, during a first type of operation the lifting knife boxes 11, 12 with the lifting knives carry out, aside from the upward and downward movement, each a lateral movement, namely for each upward or downward movement only one box carries out this lateral movement, as indicated by arrows on the right side of the figure. The lateral movement occurs in the present case during the lifting path of the lower knives 12. From this there are two advantageous results: first, the knife for the lower connecting nose of the hook in the pull *d* moves past the nose, and, second, the hook in the pull *a* is bent in cooperation with the grate 13 such that the upper connecting nose moves rightwardly and is not contacted by the upper lifting knife. The material is not worn. The curving is further promoted by the lower rigid section of the hook and the springing back occurs more rapidly.

The second type of operation of this machine may consist in that the lower lifting knife 12 during each upward and downward movement in the zone of the shed intersection carries out each one additional lateral back-and-forth movement, as shown by the arrows on the left side of FIG. 6. This assumes that during lowering of the upper lifting knife 11 the nose 3 of the hook in the pull *d* will not engage the lower lifting knife 12 and thus the lower lifting knife will follow during its upward movement a curve around the lower connecting nose 3. Simultaneously therewith, the hook in the pull *a* is curved at the control grate 13 so that the upper lifting knife 11 during its lowering movement will, first, not contact the hook and, second, will not be lowered on the wrong side of the hook, which latter could cause the hook to give way toward the left side and thus be destroyed.

Figure 7:
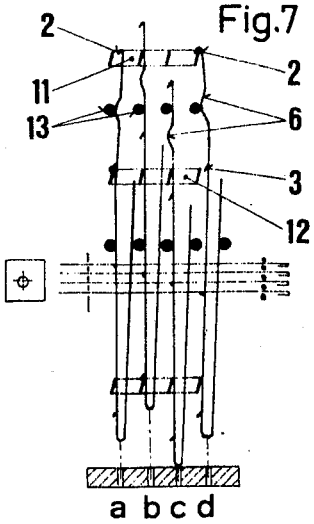
FIG. 7 illustrates schematically an operating position of a group of four needles with an offset between the connecting noses.

In the modified embodiment according to FIG. 7 the control grate 13 is arranged stationary, and the hooks have each an offset 6 between the connecting noses 2 and 3. This offset is effective during each upward and downward movement of a hook because the stronger resilient upper part is moved to the right to give way, through which the connecting nose which is not engaging a knife is no longer in the path of operation of its associated lifting knife. This is particularly important in the case of the hook in the harness pull *d.* During the lowering movement of the upper lifting knife 11, and thus the lowering movement of the hook, the lower connecting nose is supported on the rising knife 12 and the hook will be lifted. Thus the nose 3 gives way to the rising lifting knife 12. This giving way at the time of the shed crossing is materially greater if the hook has the various spring characteristics of the invention. Because of the lower rigid part the springing back following the curving is promoted so that a higher safety and a higher operating speed is achieved. In the case of the hook in the pull *a*, which engages the lower lifting knife 12 and therefore carries out an upward movement, the upper nose 2 is moved to the right. This appears to be an unnecessary movement because the upper knife 11 is inclined and the upper end of the hook would in any case be pushed away. However, in fact, it is useful because such giving way is from the beginning a non-positive movement and the resilient hook can during high-speed operation, especially in view of the often occurring uneven operation, swing laterally and therefore pass on the wrong side of the knife. Thus, with this invention, the knife no longer needs to be built as wide and heavy as previously. The hook in the pull *b* thus stands still in the upper shed and the hook in the pull *c* does likewise in the lower shed.

I claim:

1. A single-shank, resiliently flexible, hook for use in a double-lift, open-shed Jacquard machine, said hook having a body part with two vertically spaced connecting noses and a support nose mounted thereon, said support nose being arranged on the hook below said two connecting noses and a spring portion extending away from said support nose in the form of a resilient extension which is bent backward at 180° relative to said body part, comprising the improvement wherein said body part of said hook has a first zone (I) between said two connecting noses, a second zone (II) located between the lower one of said two connecting noses and said support nose and an immediate third zone between said lower one of said two connecting noses and said second zone (II), said body part in said third zone being more resilient than is said body part in said second zone (II).

2. An improved hook according to claim 1, wherein said body part is made of a resilient steel rod;

wherein said first zone (I) of said body part between said two connecting noses consists of said resiliently flexible steel rod and said second zone (II) between said lower one of said connecting noses and said support nose consists of two coextensive and overlapping steel rods, said coextensive two steel rods of said second zone (II) being connected to one another at least at two spaced locations; and wherein all said steel rods have the same spring characteristics.

3. An improved hook according to claim 2, wherein said connections at two spaced locations consist of welding or soldering.

4. An improved hook according to claim 1, wherein said body part of said hook consists of first and second steel rods, said first steel rod having an upper end which has an upper connecting nose formed thereon and a lower part, said second steel rod having a first part extending parallel to said lower part of said first steel rod, said second steel rod having said lower one of said connecting noses formed thereon adjacent the upper end of said first part, said first part of said second steel rod being connected to said lower part of said first steel rod at two spaced locations, said second steel rod having said support nose formed thereon below said lower part of said first steel rod and then is formed to a curvature and thence to said resilient extension.

5. An improved hook according to claim 4, wherein the space between the lower one of said two spaced connections between said first and second steel rods and said support nose is less than the spacing between the upper one of said two spaced connections and said support nose; and wherein each of said spacings is less than said spacing between said two spaced connections.

6. An improved hook according to claim 1, wherein said body part of said hook in said first and third zones is circular in cross section, and said second zone (II) near said support nose is a steel member having a rectangular cross section.

7. An improved hook according to claim 1, wherein said second zone (II) is almost rigid between said lower one of said connecting noses and the support nose while said first zone (I) between said two connecting noses is relatively flexible.

8. An improved hook according to claim 1, wherein said flexible body part of said hook has, between said two connecting noses, an offset therein.

9. An improved hook according to claim 8, wherein said offset is arranged approximately centrally between said connecting noses.

* * * * *